US007647648B2

(12) United States Patent
Komorowski

(10) Patent No.: US 7,647,648 B2
(45) Date of Patent: Jan. 19, 2010

(54) ADVANCED ISOLATION GOWN

(75) Inventor: Thomas Komorowski, Toms River, NJ (US)

(73) Assignee: Medical Isolation Technology, LLC, Toms River, NJ (US)

( * ) Notice: Subject to any disclaimer, the term of this patent is extended or adjusted under 35 U.S.C. 154(b) by 0 days.

(21) Appl. No.: 11/986,042

(22) Filed: Nov. 20, 2007

(65) Prior Publication Data

US 2009/0031474 A1 Feb. 5, 2009

Related U.S. Application Data

(60) Provisional application No. 60/962,403, filed on Jul. 30, 2007.

(51) Int. Cl.
*A41B 13/10* (2006.01)
*A41D 13/04* (2006.01)
*A41D 13/00* (2006.01)

(52) U.S. Cl. ..... 2/51; 2/69

(58) Field of Classification Search ..... 2/114, 2/106, 456, 69.5, 94, 101, 304, 312, 315, 2/253, 51, 10, 250, 457, 242, 901, 902, 903, 2/227, 69
See application file for complete search history.

(56) References Cited

U.S. PATENT DOCUMENTS

D111,803 S * 10/1938 Bailey ..... D2/857
2,642,576 A 6/1953 Kotkes
3,496,572 A 2/1970 Herzig
4,171,542 A * 10/1979 Cox et al. ..... 2/51
4,389,734 A * 6/1983 Franz et al. ..... 2/59
4,637,075 A 1/1987 Ingrisano et al.
4,718,124 A 1/1988 Sawicki
4,791,681 A 12/1988 Dean
4,860,388 A 8/1989 Dean
5,097,534 A 3/1992 Viemeister et al.
5,142,704 A * 9/1992 Viemeister et al. ..... 2/202
D336,968 S 7/1993 Russano
5,414,867 A * 5/1995 Bowling et al. ..... 2/51
5,652,961 A 8/1997 Knight-Yurt
6,154,888 A 12/2000 Krohn
6,286,147 B1 9/2001 Ingold
6,308,875 B1 * 10/2001 Almo ..... 224/660
6,477,710 B1 11/2002 Ojoyeyi
6,484,321 B1 11/2002 Shamam
D476,137 S 6/2003 McFarlane
6,574,800 B1 6/2003 Leger et al.
6,647,552 B1 11/2003 Hogan
6,687,919 B2 2/2004 Dilworth, Jr. et al.
6,763,527 B1 7/2004 Rivoli et al.
7,010,812 B1 3/2006 Cho et al.
7,073,204 B1 7/2006 Boyles
7,181,773 B1 2/2007 Piraka
7,296,652 B1 * 11/2007 Rosenberg ..... 181/131
2002/0162154 A1 11/2002 Shamam
2003/0131401 A1 7/2003 Dilworth, Jr. et al.

(Continued)

*Primary Examiner*—Gary L Welch
*Assistant Examiner*—Amber R Anderson
(74) *Attorney, Agent, or Firm*—Arthur M. Peslak, Esq.; Mandel & Peslak, LLC

(57) ABSTRACT

A medical isolation gown is disclosed. The gown is to be used by medical personnel treating isolated patients with contagious diseases. The gown comprises slots and pouches that can be used to isolate the worker and his or her instruments from contamination when examining or attending the patient.

6 Claims, 10 Drawing Sheets

U.S. PATENT DOCUMENTS

2004/0226073 A1 11/2004 McCullar et al.
2005/0102731 A1 5/2005 Beuk
2006/0064797 A1* 3/2006 Pyeatt Rowe et al. ..... 2/244
2008/0092261 A1* 4/2008 Yu et al. ..... 2/16

* cited by examiner

ADVANCED ISOLATION GOWN

PRIORITY

This application claims priority to U.S. Provisional Patent Application No. 60/962,403 filed Jul. 30, 2007.

BACKGROUND OF THE INVENTION

The present invention is directed to a medical isolation gown that is shaped and equipped with pouches, slots, convenient entry openings, closing mechanisms, additional barriers, upper and lower extremity coverings with shoe pouches in a one size fits all solution. The present invention is meant to be utilized by medical personnel or others who are attending to patients isolated due to contagious diseases. The primary object of the present invention is to provide an uninterrupted layer of isolation and improve isolation integrity, and thereby enhance the degree of protection from contamination. The present invention thus decreases the chance of contamination of the user. In addition, its user friendly shape improves worker compliance with isolation regulations.

The present invention protects not only the worker but also an instrument/tool used by the worker from contamination. Thus, the worker's safety in using the tool is improved since the tool is not contaminated. It eliminates the risk of cross-contamination or contamination between workers by eliminating the need to use shared instruments, as well as a risk of self-contamination while using unprotected and contaminated instruments.

In a hospital setting, a patient with an infectious disease is generally isolated in a room, which is considered contaminated. The hospital generally dedicates one, poor quality stethoscope, for that patient room, to be used by all healthcare personnel who may attend or treat the patient. Naturally as it is used, the stethoscope becomes contaminated by contact with the patient as well as by manipulation of healthcare persons who touch the stethoscope with already contaminated gloves. The healthcare professionals, by standard procedures of examining the patient, are forced to touch and use the same shared and contaminated stethoscope again and again. The same contaminated stethoscope is placed on the face and into the ears of the next doctor/nurse in the room examining the patient. This creates a hazard of contaminating a healthcare worker's face or ears by use of the contaminated stethoscope, which is already contaminated with the patient's or other healthcare worker's pathogens.

The present invention seeks to eliminate or reduce the risk of contamination, by eliminating the need for the use of contaminated tools by the healthcare worker, as well as providing a full and continuous layer of contact isolation. Another object of the present invention is to reduce the risk of patient as well as healthcare worker contamination with pathogens from another patient, or from another healthcare worker.

Another object of the present invention is to improve the quality of care by reducing the chance of a patient dying and/or suffering due to hospital-acquired infection. In addition, the present invention may lower healthcare costs by further reducing the risk of contamination, and the costs associated with the treatment of hospital acquired infections as well as eliminating the costly need for disposable/shared instruments which normally are dedicated to the contaminated patient area and later disposed of.

Another object of the present invention is to improve healthcare worker compliance with isolation guidelines by creating a user friendly isolation gown. The present invention is user friendly because it allows the worker, by putting the "one piece" isolation gown on, to achieve all steps necessary before entering the isolation room. In addition, it allows the workers to use their own dedicated medical instruments rather than shared instruments.

Another object of the present invention is to improve the quality of patient care by improving the healthcare workers attendance to persons in isolation by reducing the incidence of doctors avoiding the examination of isolated patients due to inconvenience and excessive time consumption of examination in an isolation room. This is achieved by user-friendly construction of the gown as well as allowing the worker to use better quality, personal instruments. e.g. stethoscopes. These are generally better tools, more likely to be used by healthcare workers than those found in contaminated rooms and can produce a more accurate diagnosis.

BRIEF DESCRIPTION OF THE DRAWINGS

FIG. 8*aa* illustrates the Lower Extremity Isolation System.

SUMMARY OF THE INVENTION

Figure 1:
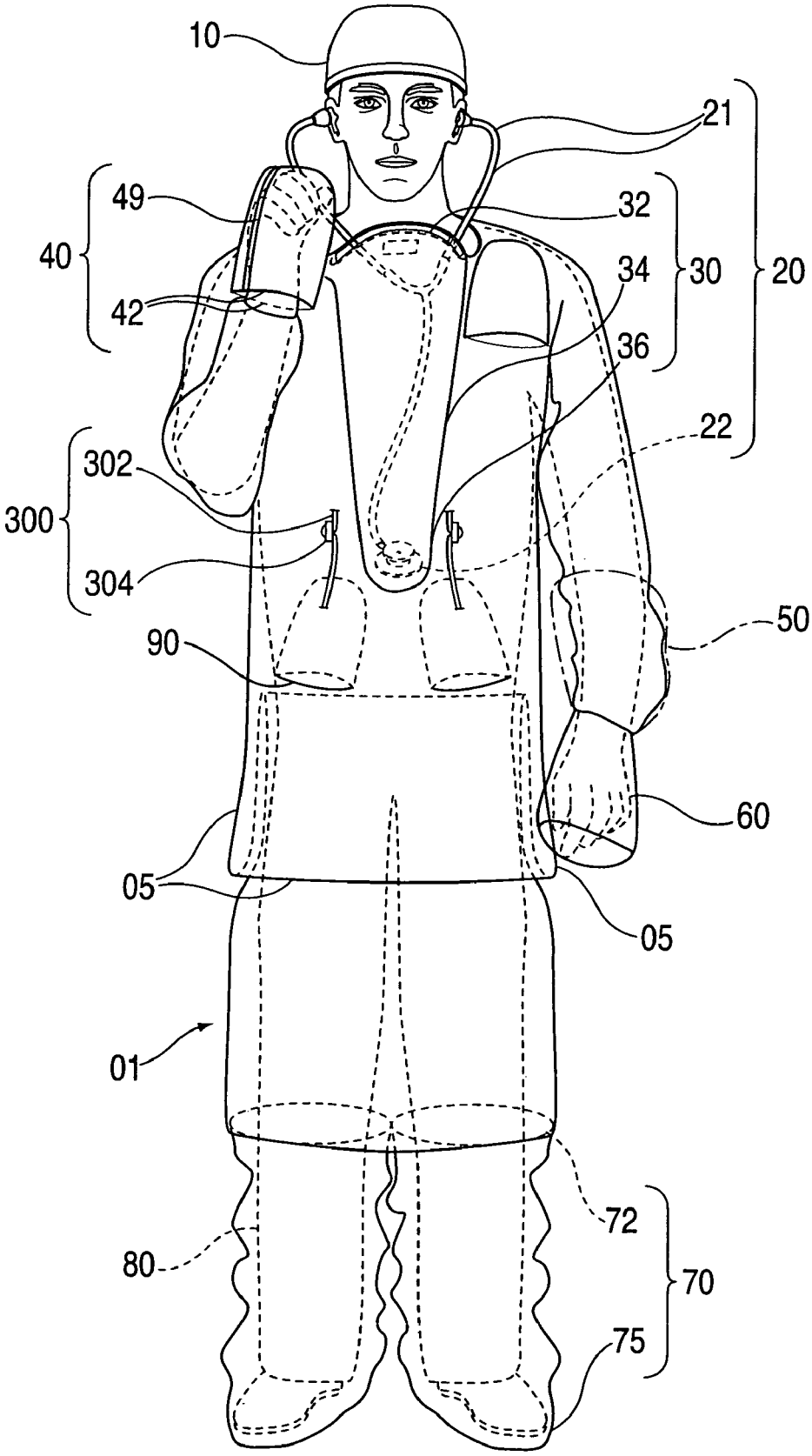
FIG. 1 is a front perspective view of a doctor/nurse wearing the Advanced Isolation Gown (AIG) of the present invention.

The Advanced Isolation Gown ("AIG") of the present invention is an isolation system for use by medical personnel. The AIG is equipped with Dedicated Instrument Slots ("DIS"), Secondary Isolation Barriers ("SIB"), as well as End Closed Sleeves ("ECS"), a Glove System (GS), a Claw Shaped Inner Pocket (CSP), Secondary Isolation Over-Sleeve (SIO), Lower Extremity Isolation System (LEIS) with an open arch shoe habitat system (OAHS) and/or "Step On" Shoe Isolation Sole (SIS), and Semi-End Closed Sleeves (SECS). In addition, the AIG comprises a one size fits all adjusting belt and accordion shortening modifications (ASM) throughout the isolation gown on the torso, arms, legs and shoe covers.

The following items are set forth in the drawings:

80 The healthcare worker's Lower Extremity (LE)
82 The Shoe
90 Claw Shaped Inner Pocket (CSP)
102 The healthcare worker Upper Extremity (UE)
112 The closure of DIS entry port (32), with any sticky or snap, mechanism
130 Shoe Isolation Sole (SIS)
132 Facing the shoe "sticky" surface, where any material or product that provides secured contact of the shoe sole to the SIS can be used
134 Middle support layer, is optional
136 Facing the floor anti slid layer.

200 AIG head opening, full around the neck.

210 Reverse V shape opening cut at the back of the AIG, at its cranial side.

215 Reverse V shape opening cut at the back of the AIG, at its caudal side.

220 The V shape opening closing mechanism snap, (Velcro patch, any mechanisms providing adhesiveness).

222 The snap (220) on the inner side of the coat.

224 The snap (220) on the outer side of the coat figure.

300 The size adjusting belt system, where tying the belt allows for pulling the gown upwards and trapping the excess of material beneath the belt, and therefore adjusting the length of material.

302 Belt.

304 Belt cleat.

400 Semi-End Closed Sleeves (SECS).

410 Thumb opening.

420 Gown sleeve opening with elastic ring allowing for tight, on this picture mid palm/hand position.

430 Hand.

440 Gown Sleeve with an arm inside.

The user of the AIG places his or her instruments, i.e. a stethoscope, into the DIS. The DIS enables the instrument to be protected from contamination when used in a contaminated area. The SIB allows for protected (without self contamination) touching and operating of instruments/objects by the worker with contaminated hands/gloves, when still in the contaminated area. The ECS, SECS and SIO allow for additional hand protection and offer convenience of use. The LEIS with its OAHS allows for lower extremities protection that is integrated with the gown for convenience of use. The system is provided with one or more accordion like features located in different areas so that the system is one size that fits all users, which is a part of this invention.

DETAILED DESCRIPTION OF THE INVENTION

The present invention will now be described in terms of the presently preferred embodiment thereof. Those of ordinary skill in the art will recognize that many obvious modifications may be made thereto without departing from the spirit or scope of the present invention.

The Advanced Isolation Gown (AIG) 01, and/or the concept itself, may be used in a variety of industries, not only to protect from contamination due to pathogens, but also from different elements, toxins, dirt, contamination, etc. FIG. 1 illustrates the use of a Dedicated Instrument Slot (DIS), [and] Secondary Isolation Barrier (SIB), and Lower Extremities Isolation System (LEIS). The AIG 01 with its innovative concept of a DIS 30 and/or an SIB 40, can be used on a macro scale where larger instruments are to be protected or on a micro scale where smaller working instruments would be isolated. The AIG 01 can be fabricated from a variety of materials including, but not limited to, fabric, plastics, metals, papers, or any other appropriate material. Each part of the AIG 01, e.g. the DIS 30, SIB 40 and ECS/GS 60, CSP (90), SECS (400), LEIS (70), and SIS (130) SIO (50) ASM (05) and all parts are independent and may be used independently and not in conjunction with the others. As described herein, all of these elements can be used together.

As shown in FIG. 1, the preferred embodiment of the AIG 01 comprises various components.

First, the Dedicated Instrument Slot (DIS) 30 is an isolation gown special slot, referred to herein as an out-pouch. This DIS 30 is adapted for insertion therein of a worker's instrument(s). The DIS 30 creates the opportunity to use non-contaminated instrument(s) that will be located therein and protected from contamination by the AIG 01. The entry to the DIS 30 is located on what is considered the clean, inner surface 32 of the AIG 01, where the worker is also located. For example, the stethoscope 20, which a nurse or doctor 10 has on his or her neck, will fit easily into the DIS 30. The opening 32 on the top of the DIS 30 for insertion of the stethoscope 20 is located on the internal side of the gown 01, on its front plane around the upper chest area. The distal end 22 of the stethoscope 20 is located inside the DIS 30 while the proximal end 21 will be exposed outside of the AIG 01. The DIS 30 comprises an arm 34 extending outside of the gown, providing for unrestricted manipulation of the stethoscope or other instrument that is inserted into the DIS 30, as well as the distal end of the arm 36, inside of which the stethoscope bell 22 is located.

Figure 2:
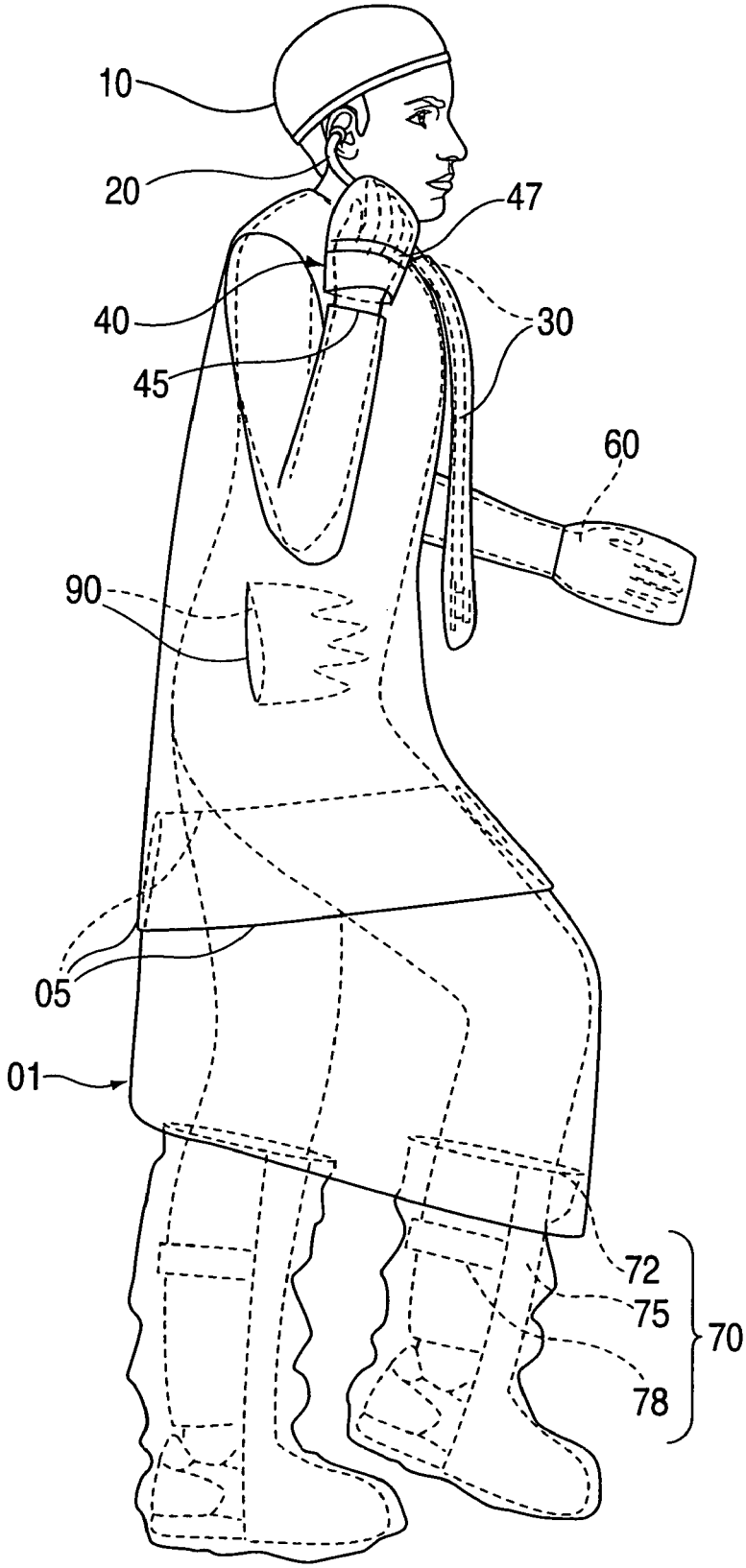
FIG. 2 is a side perspective view of the AIG.
Figure 3:
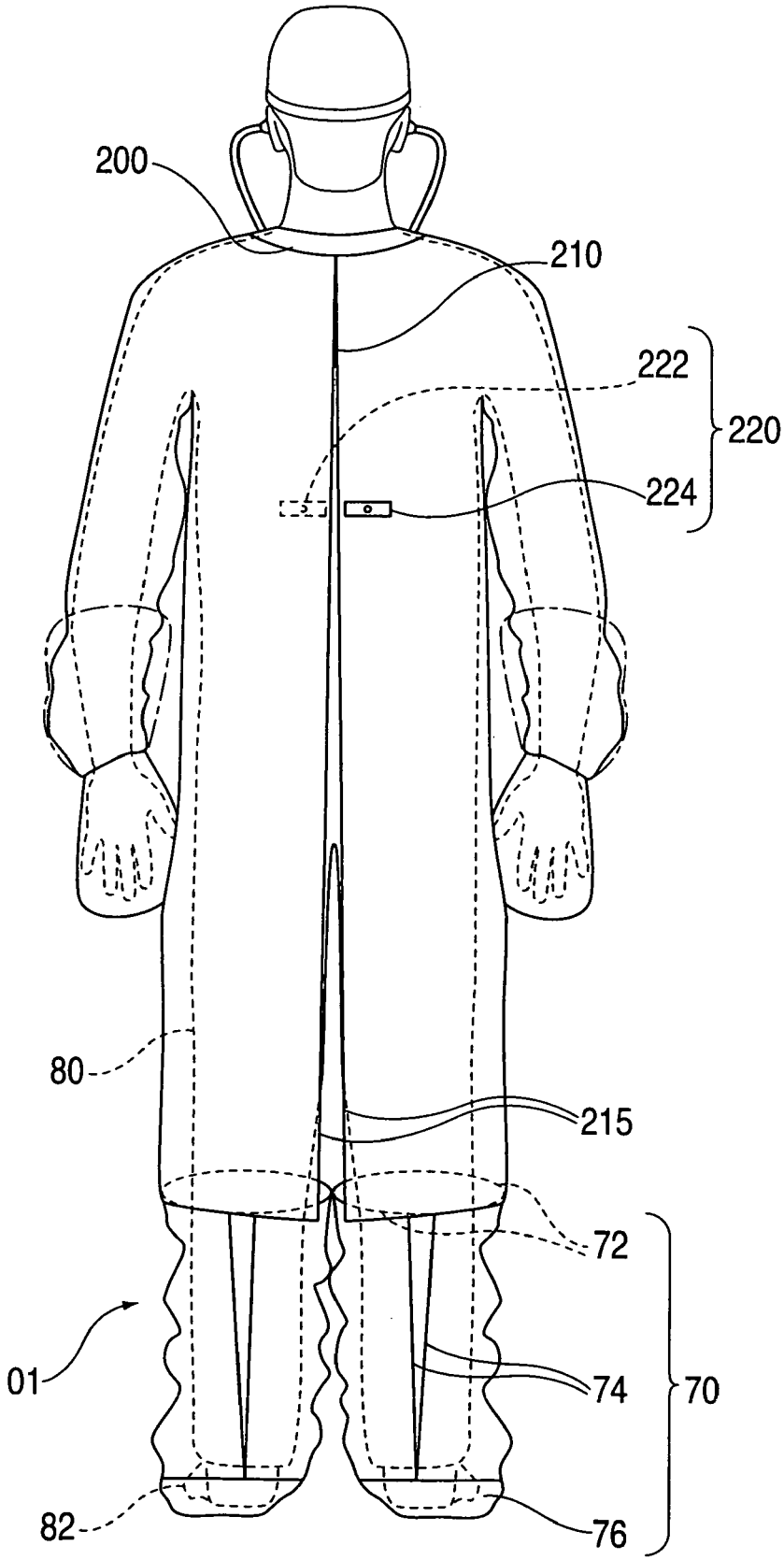
FIG. 3 is a back perspective of the AIG demonstrating the back closure mechanism (BCM) of the AIG as well as back closure mechanism of the LEIS

The AIG 01 is designed to be one size to fit all users. It comprises an accordion like fold or folds 05, shortening the gown as illustrated in FIG. 1, but the fold 05 may be extended if a taller person is the user, as illustrated in FIG. 2. The one size fits all mechanism in the gown and/or any other parts described herein, can be done by the accordion design, by folds, material overlaps, elastic or any other means of achieving a lengthening or shortening effect. The accordion design fold(s) 05 can be located in different areas of this invention, e.g. arm sleeves, leg protections, etc.

The Secondary Isolation Barrier (SIB) 40 is an isolation sleeve located on the outer surface of the gown 01 near to the user's shoulder. The SIB 40 is essentially a pouch/pocket and is designed for placing contaminated hands/gloves inside for isolation, while allowing at the same time, for operation of the stethoscope 20 by the hands. The SIB 40 gives the worker, when in the contaminated area, constant access to parts/areas of the instruments/body that are not isolated inside the AIG 01 and require protection from contamination. For example, a nurse may examine a patient in isolation but needs to listen to the patient's lungs. However, her isolation gloves and gown are already contaminated and she has no easy safe way to touch the upper part of stethoscope 20 in order to use it, and not contaminate herself through touching herself with contaminated gloves. But with the SIB 40 she simply inserts her hands into the SIB entry port 42 located outside of the AIG 01 and, with its layer of isolation, can operate the stethoscope 20 as she requires. She will use the same SIB 40 later when she is ready to take off her stethoscope and exit the contaminated area. The SIB 40 is provided with elastic 49 which compresses the SIB 40 when not in use. The arm sleeve end of the gown is enclosed, by the End Closed Sleeves (ECS) 60. The ECS 60 can be either a glove, a pouch, or just a blind end, so the hand is inside the gown.

The ECS 60 provides continuity with the AIG 01 layer of isolation provided by the AIG 01. The ECS 60 stretch design also allows for one size fits all utilization. The ECS 60 is comprised of at least one or more layers. The ECS 60 comprises an external layer 62 made of material with isolation properties. e.g. latex, as well as with elastic properties to allow for expansion for larger hand size, but preventing discomfort of use with a smaller hand size. Alternatively, any material with isolation properties and sufficient elasticity can be used. Such a material layer could be folded in accordion-like fashion 05, that can be extended in larger hands and compressed for a smaller hand. An Inner layer 64 of the ECS 60 is optional and is made of elastic material e.g. spandex, giving support for the external layer 62.

The Claw Shaped Inner Pocket ("CSP") 90 is illustrated in FIG. 1. The CSP 90 is designed so the healthcare worker can reach and manipulate objects underneath the AIG 01. The CSP 90 corresponds to a layer of material that can be moved from position 50 to position 55 where it protects the ECS 60 from secondary contamination and/or can provide an extra layer of isolation if required.

Figure 8:
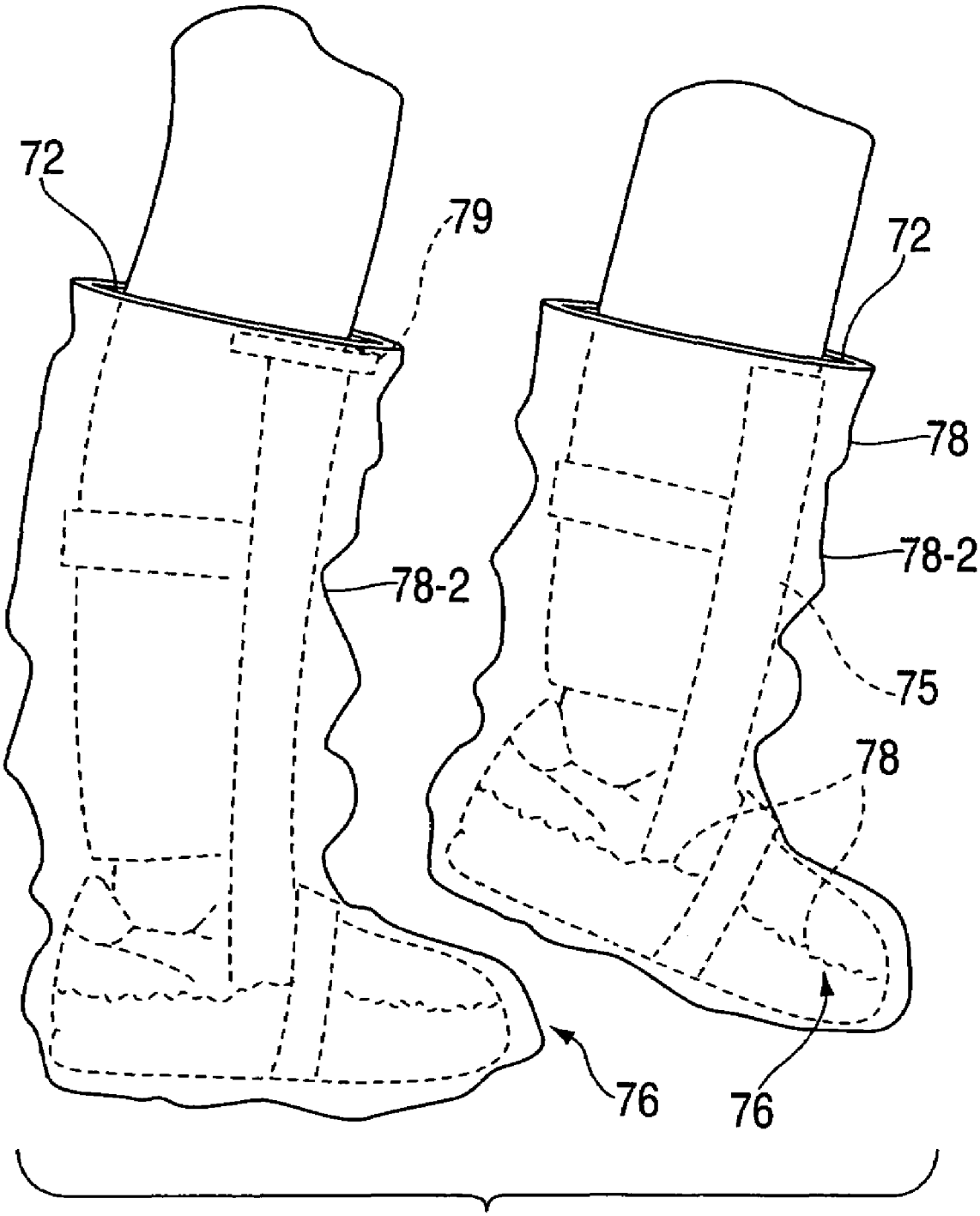
FIG. 8 illustrates the Lower Extremity Isolation System.
Figure 8A:
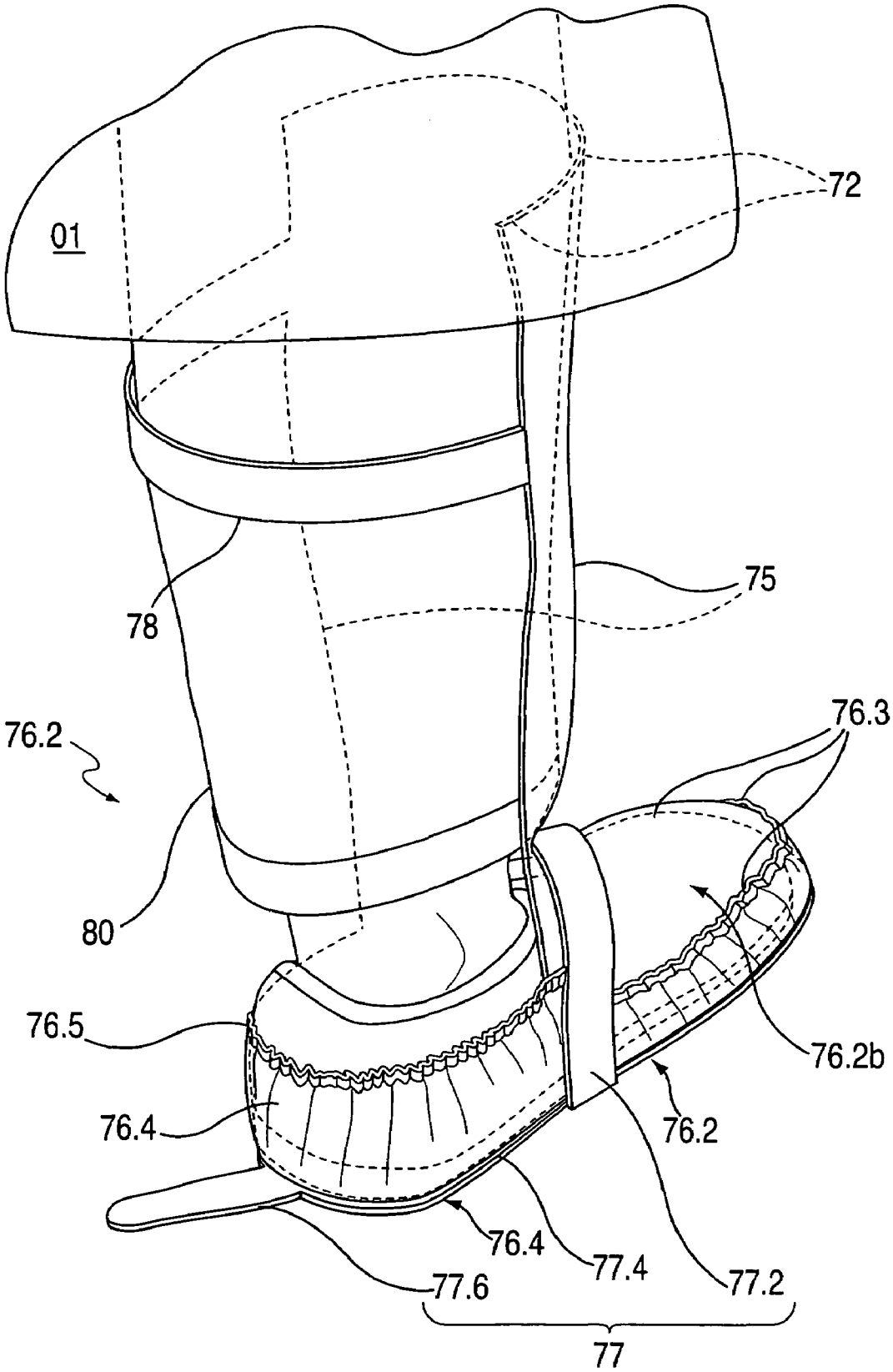
FIG. 8*a* illustrates the Lower Extremity Isolation System with LE positioned inside the LEIS.
Figure 8A:
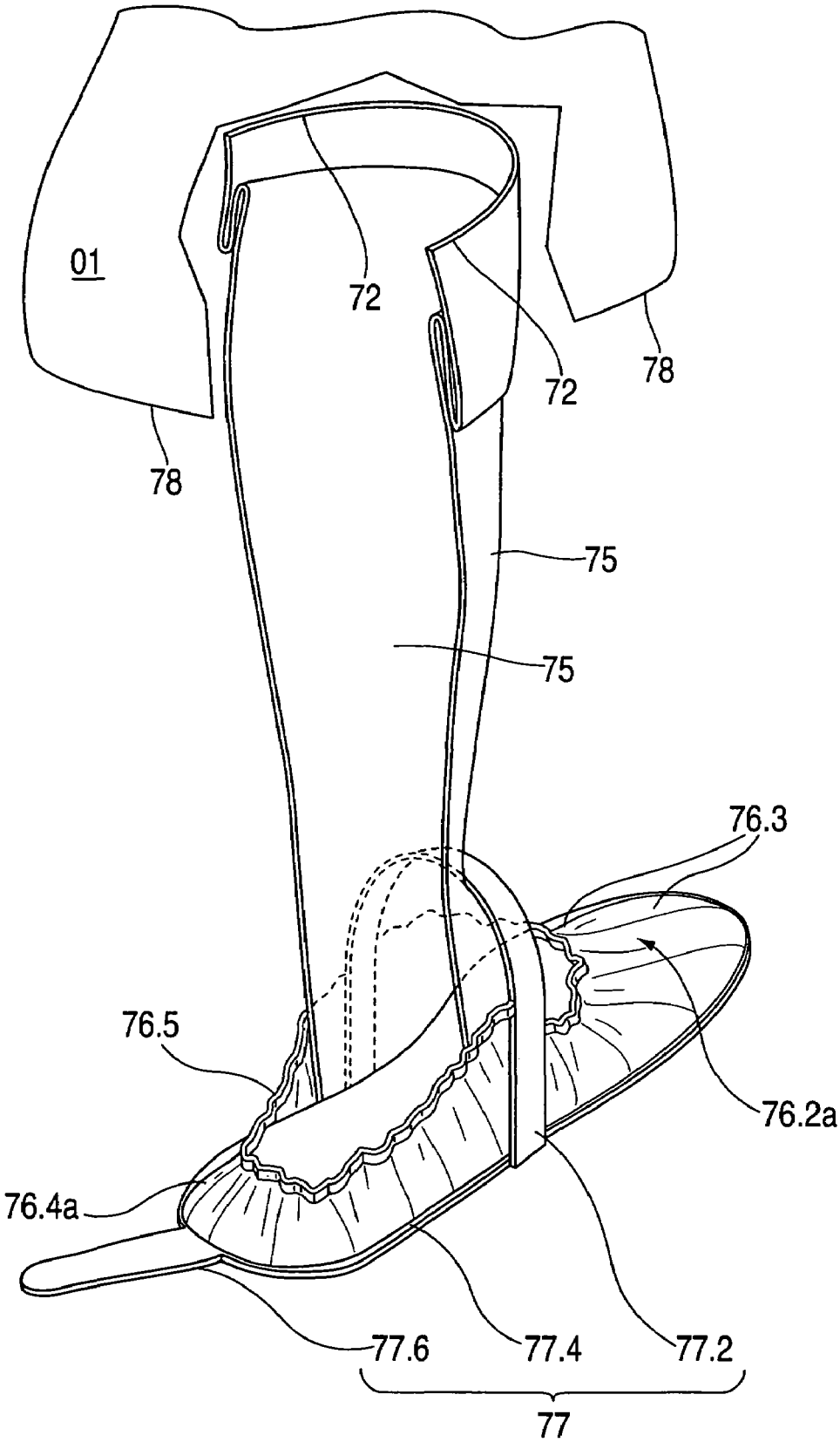
Figure 9:
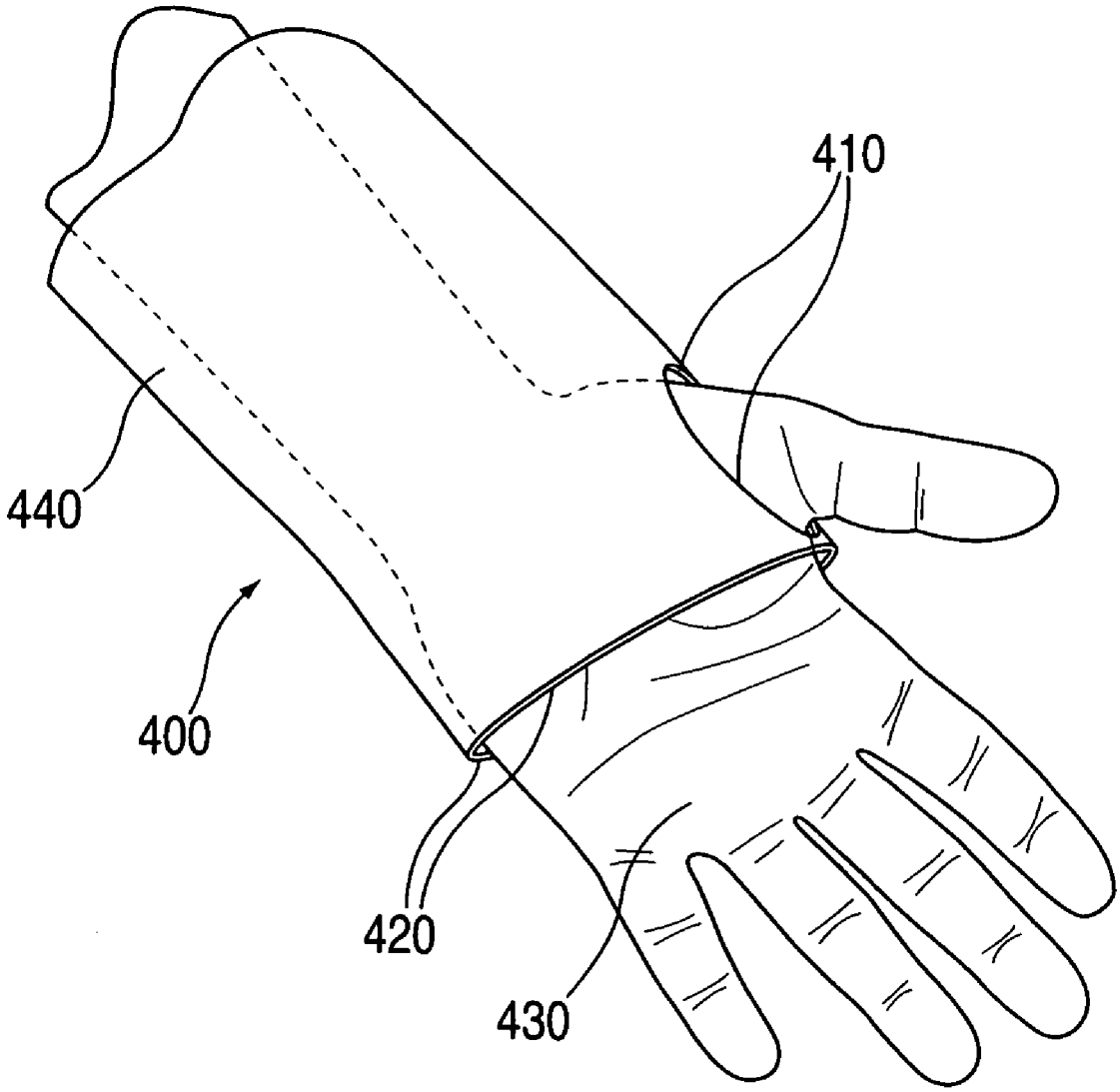
FIG. 9 illustrates the Semi-End Closed Sleeves (SECS).

The Lower Extremity Isolation System ("LEIS") 70 consists of openings 72 attached inside the gown at the front or other site allowing for leg entry. The LEIS body 75 is open at the back, but closed at the front as shown in FIG. 8*a*. The LEIS body 75 has an accordion-like fold or ASM 78.2, which allows for user height adjustment. On the side of the LEIS body 75, there are elastics 78, which allow for initial high positioning of the LEIS 70 to prevent dragging on the floor if it is not used as well as adjustment to user height along with the ASM 78.2.

The body of the LEIS 75 is adapted to join the shoe habitat of the LEIS (SH-LEIS) 76. The SH-LEIS 76 is a supportive structure, the Open Arch Shoe Habitat system (OAHS) 77, consisting of the arch, the sole and the spur. The arch 77.2 provides the constant open entry for no hassle shoe sliding into the LEIS shoe habitat. The sole 77.4 of the shoe habitat provides support for the heel of the shoe and ends with the arch, allowing for the elastic shoe habitat (76.2) to expand or not, to provide coverage for various shoe sizes. The spur 77.6, is the sole extension, allowing for a stepping on and immobilizing shoe habitat for facilitated shoe entry.

At the front of the OAHS 77 arch, there is the toe part of SH-LEIS 76.2*b*. At that end, the material and elastic 76.3 around it create an expandable shoe pouch. At the back of the OAHS 77 arch, there is a heel part of the SH-LEIS 76.4 with elastic material 76.5. It is illustrated with its two positions in FIG. 8. First, when the heel part of the SH-LEIS is compressed 76.4*a* against the sole of the OAHS 77 and second when it is raised and covering the shoe 76.4*b*. Alternatively, the LEIS 70 could be any shape to cover the legs and shoes attached to the gown. Here the LEIS 70 opening is kept wider by supporting and expanding element 79 as shown in FIG. 8. The LEIS entry port opener is made of any supportive material, or expanding material that keeps the entry port of the LEIS open, preventing collapsing, and enables leg insertion. The left leg demonstrates the closed variation of the LEIS 70, whereas the illustration on the right leg demonstrates the LEIS 70 with the back open design further illustrated in FIG. 8 and FIG. 8*a*. The shoe habitat 76 of the LEIS is illustrated in FIG. 8. The shoe habitat 76 comprises the following items:

The toe site of 76.2*a* of the shoe habitat as it is shrunk by the elastic and folded is shown in FIG. 8*aa*. The toe site 76.2*a* of the shoe habitat as it is expanded on the shoe to provide isolation for all shoe sizes is shown in FIG. 8*a*.

The AIG 01 further comprises Semi-End Closed Sleeves (SECS) 400 with an extension of the AIG 01 arm sleeve 440 into the palm area. The sealing mechanism for the SECS 400 consists of a thumb hole 410 and palm sleeve opening 420. If used in conjunction with a surgical glove on the user's hand, the SECS 400 allows for a complete and uninterrupted isolation barrier for the user's hands.

Figure 6:
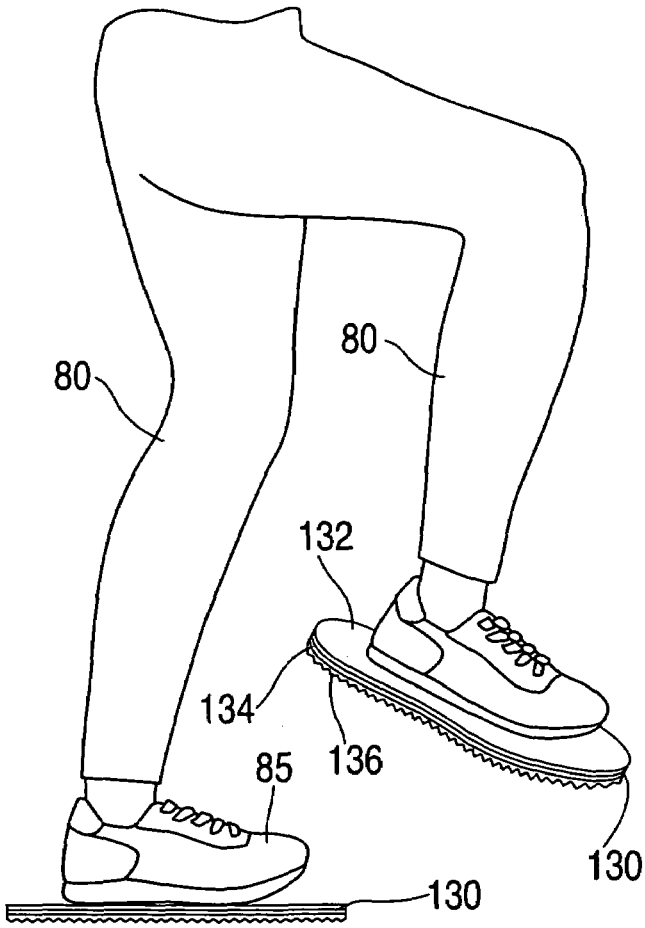
FIG. 6 illustrates the Shoe Isolation Soles (SIS) of the present invention.

The Shoe Isolation System ("SIS") 130 allows the user to "step on and go." The Shoe Isolation System 130 comprises a sticky layer on one side to stick to the user's shoe and an optional non-skid layer on the opposite side as shown in FIG. 6.

Figure 4:
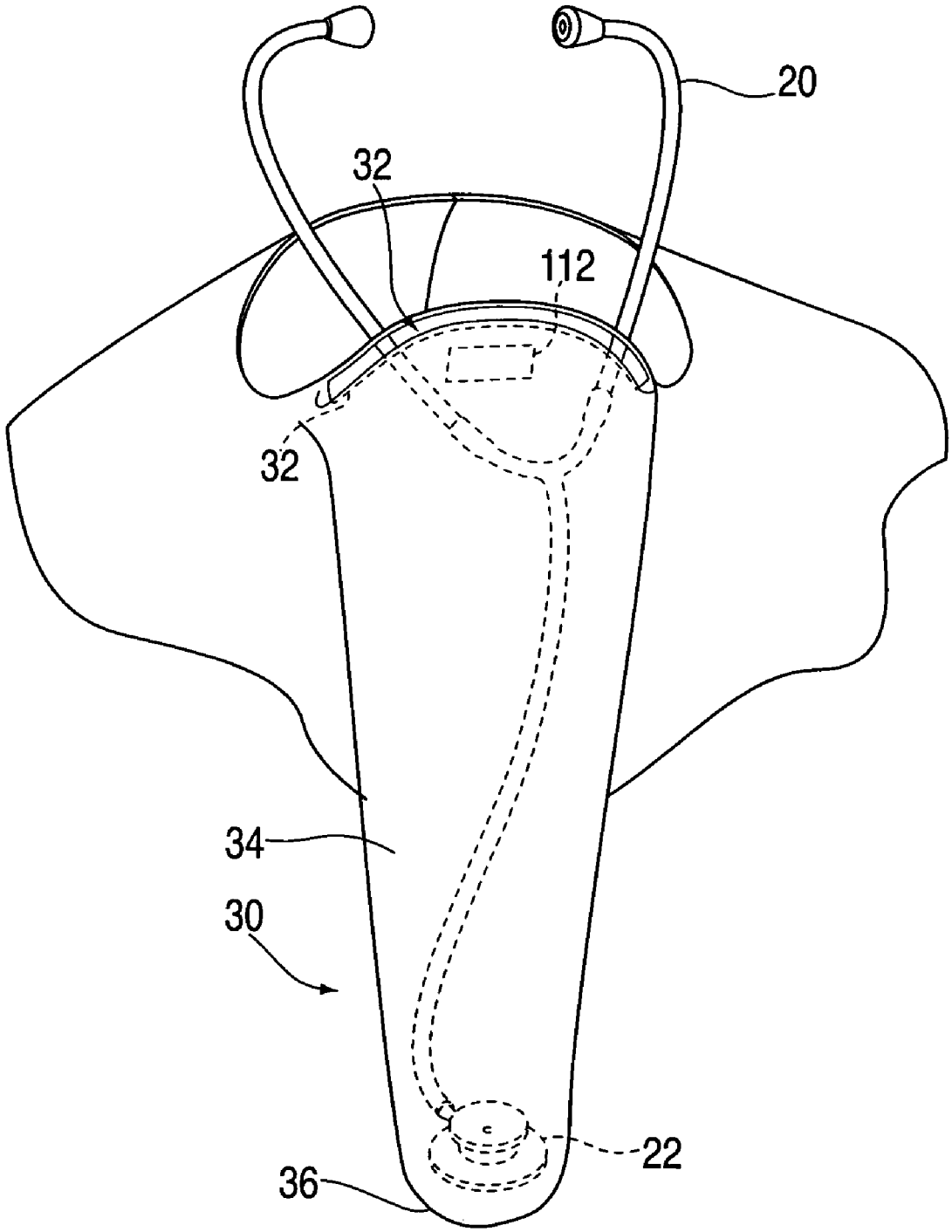
FIG. 4 is an alternate embodiment of a component of the present invention.
Figure 5:
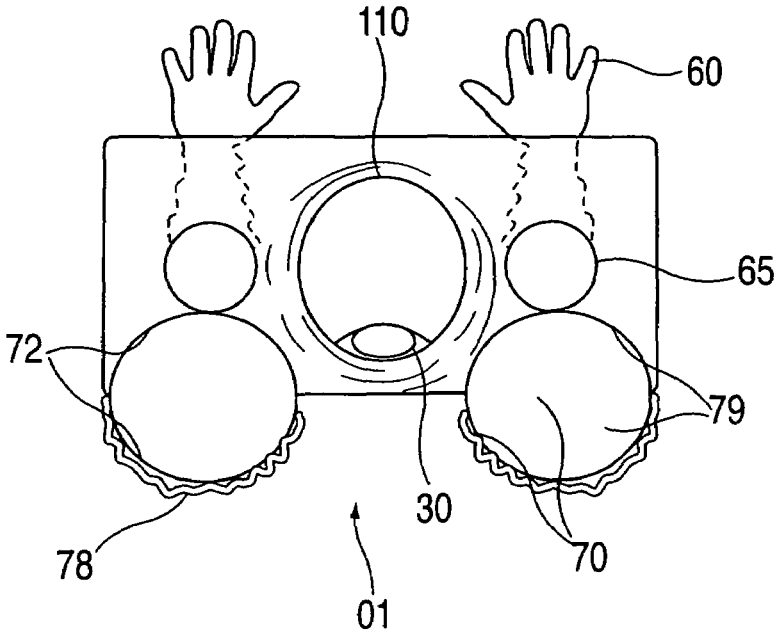
FIG. 5 illustrates the packaging and folding of the present invention prior to use.

The AIG 01 in its folded condition prior to use is illustrated in FIG. 4. The AIG 01 will be pre-folded as shown in FIG. 4. The user will first place his or her arms into the sleeve openings 65 and then his or her head into the head opening 110. These openings are accessible from the inner surface of the AIG 01. The user then extends his or her arms into the end 65 of the arm sleeves. Next, by leaning forward and detaching, if necessary, the user will position the LEIS 70 and its open arch shoe habitat system OAHS 77. Here, like into slippers, the user will place the shoes. A spur 77.6 can be used, if necessary, by stepping on it with one foot, and pushing into the OAHS 77 with the other. When both shoes are in the OAHS 77, the user will rise expanding, if necessary, the accordion systems 05 throughout the AIG 01. If necessary, the heel part of the SH-LEIS 76.4 can be raised as demonstrated in FIG. 8.

Upon entry into the contaminated area, the worker will isolate himself/herself with the AIG 01 by placing the AIG 01 over his/her body in a conventional manner. The worker would place his instrument(s) through the opening 32 and into the DIS 30 thereby achieving complete isolation of worker and the tools inside the AIG 01. When it is necessary to manipulate the instrument in the contaminated area, as well as upon exiting from the contaminated area, the worker uses the SIB 40 to touch and operate certain parts of the instruments, which are located inside the DIS 30, for prevention of self and/or instrument contamination.

Figure 7:
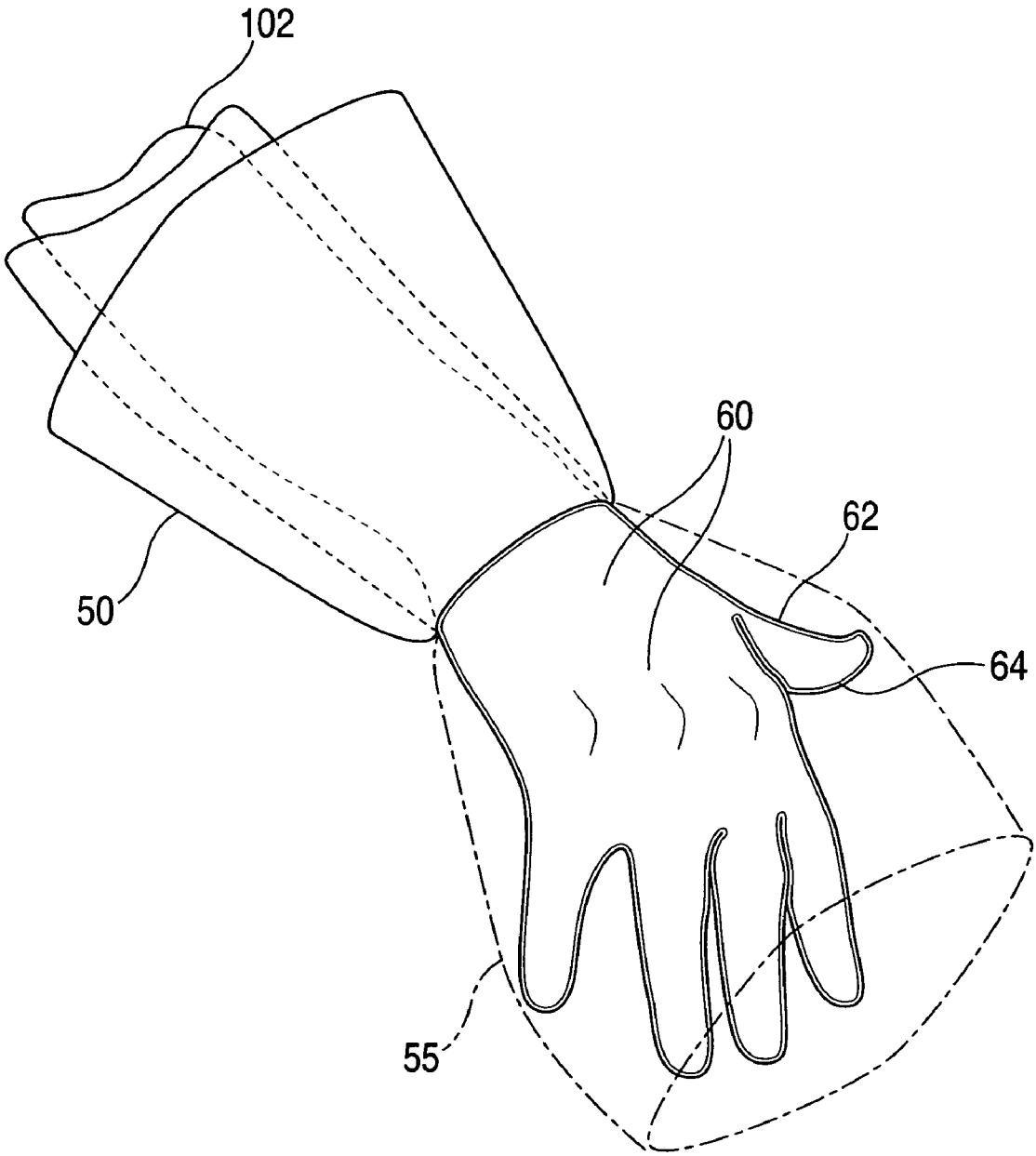
FIG. 7 illustrates the arm with the Secondary Isolation Over-Sleeve (SIO), Glove System (GS).

The following is an example of how the present invention can be used in medical settings:

The nurse, prior to entering the room of a patient in isolation due to a contagious disease, will put on the specially designed gown AIG 01 as explained above in connection with FIG. 4. She would place her stethoscope 20 inside the DIS 30 through the opening 32 on the inside of the AIG 01. She and the stethoscope 20 are now both isolated from the environment and potential pathogens. She walks into the patient contaminated room with her legs isolated and protected by the LEIS 70 and her hands protected by the ECS 60 or SECS 400 with regular surgical gloves 47 on top of the AIG 01 which allows for eliminating space between the glove and the healthcare worker arm/hand. The ECS 60 extends beyond the wrist to the palm area, and is secured by the thumb hole and the elastic. In FIG. 7, it is secured in the mid-palm position. She examines the contaminated patient. At that point, her gloved hands are considered to be contaminated since they were in direct contact with a contaminated patient. She needs to perform auscultation, and therefore places the stethoscope 20 into her ears. In order to place the stethoscope 20 into her ears, she needs to use her hands. Since her gloved hands are contaminated, in order to perform this task without secondary contamination, meaning contaminating herself with her own gloves, she uses the SIB 40. She puts her contaminated gloved hands inside the gown folds/slots that form the SIB 40 on her chest and shoulders. Now, with her gloved hands inside the SIB 40, she can touch and operate the stethoscope 20 with the clean, exterior surface of the SIB 40. She places the stethoscope 20 into her ears without contaminating the stethoscope, her skin and/or her clothes around the stethoscope ear piece 21. The nurse completes the exam and uses the stethoscope 20 to listen to the patient. To remove the stethoscope 20, she again utilizes the SIB 40. The Nurse then appropriately removes and discards the AIG 01 upon exiting the contaminated area.

Those of ordinary skill in the art will recognize that there can be numerous obvious modifications of shapes, cuts and/or structuring of the material, to obtain the goal of isolating the worker/operator together with the instruments. These modifications can be achieved by essentially creating the instruments slots, and/or secondary contamination barriers. Also the advanced isolation gown can be "broken" into two or more pieces, to separately protect/isolate the worker or parts of the worker's body, and the tools/instruments that the worker is using. All different variations, to fulfill the innovative goal of isolation not only of the worker but the multiuse instruments the worker uses. For example, the ECS 60 can be formed as just a "blind" sleeve end, or a pouch, or glove at the end of the sleeve such as shown in FIG. 7. Alternatively, it can be formed in any other shape which isolates the hand inside the gown from the outside contaminated environment.

The present invention is also directed to isolating the stethoscope or other tool used in a contaminated area, by creating essentially a protective cover for it as illustrated in FIG. 4. This can be achieved by use of a protective layer 30 that would partially or completely embrace the instrument/tool e.g. the stethoscope. This could be used as for example a separate stethoscope protective cover. The protective layer 30 further comprises a joining device 100. The joining device 100 can be any sort of sticky material, snap or other method so that the protective layer 30 can be joined to the instrument. The protective layer 30 could be anywhere from long to short, and cover anywhere from entire to only a small portion of the stethoscope, e.g. a stethoscope head only cover "a cup" or, as shown in FIG. 2, the cover of the stethoscope trunk and head.

Those of ordinary skill in the art will recognize that many obvious modifications can be made to the embodiments described above without departing from the spirit or scope of the present invention as set forth in the appended claims.

What is claimed is:

1. A medical isolation gown comprising:

a. a garment for covering the torso, arms and legs of a user comprising an inner surface, an outer surface and an opening for the head wherein the inner surface is adapted to be in contact with the user's body;

b. an instrument cover integral with the garment and protruding from the outer surface thereof wherein the instrument cover comprises an opening in the inner surface of the garment and the instrument cover is adapted to receive a medical instrument through the opening in the inner surface of the garment such that the instrument may be used to examine a patient wherein the portion of the medical instrument that will contact the patient is enclosed by the instrument cover and the outer surface of the garment is in contact with the patient; and c. a plurality of sleeves affixed to the garment adjacent the opening for the head adapted to receive the user's hand that are accessible from the outer surface of the garment and form a barrier between the user's hand and a part of the medical instrument exposed above the opening for the head so that the user can manipulate the exposed part of the medical instrument without contacting any pathogens on the exposed part of the instrument; wherein said plurality of sleeves have a closed top portion and an open bottom portion for entry of a user's hand.

2. The medical isolation gown of claim 1 further comprising a means for protecting the user's hands from contamination, that is integral with the medical isolation gown.

3. The medical isolation gown of claim 2 wherein the means for protecting the user's hands is an enclosure on the end of each garment arm integral with the garment arm so that the user's band contacts only the inner surface of the garment.

4. The medical isolation gown of claim 1 further comprising an isolation system for the lower extremities of the user.

5. The medical isolation gown of claim 1 further comprising a plurality of folds in the garment that adapt the gown to fit a plurality of users of different sizes.

6. The medical isolation gown of claim 1 further comprising a shoe habitat whereby the shoe habitat allows the user to slip their foot therein through the inner surface of the gown to cover their feet.

* * * * *